US006217243B1

(12) United States Patent
Monin-Bareil

(10) Patent No.: US 6,217,243 B1
(45) **Date of Patent: *Apr. 17, 2001**

(54) LIPSTICK TUBES

(75) Inventor: Richard Monin-Bareil, Barcelona (ES)

(73) Assignee: Techpack Espana, S.L., Barcelona (ES)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/243,465

(22) Filed: Feb. 3, 1999

(30) Foreign Application Priority Data

Feb. 3, 1998 (ES) ..... 9800286 U

(51) Int. Cl.[7] ..... B43K 23/00

(52) U.S. Cl. ..... 401/98; 401/78

(58) Field of Search ..... 401/78, 98, 55, 401/58, 52, 202, 262

(56) References Cited

U.S. PATENT DOCUMENTS

| | | | | |
|---|---|---|---|---|
| 5,715,961 | * | 2/1998 | Robertson | 215/319 |
| 5,749,664 | * | 5/1998 | Inoue et al. | 401/78 |
| 5,813,421 | * | 9/1998 | Wang | 132/318 |
| 5,863,144 | * | 1/1999 | Ackermann | 401/78 |
| 5,984,554 | * | 11/1999 | Bouix | 401/98 |

* cited by examiner

*Primary Examiner*—Gregory L. Huson
*Assistant Examiner*—Huyen Le
(74) *Attorney, Agent, or Firm*—Dennison, Scheiner, Schultz & Wakeman

(57) ABSTRACT

The lipstick tube (20) has a cap (5) to be coupled by pressure on a collar (4) emerging axially from the tube body (1), characterised in that it comprises a ring of material (6) having a flexible free end (16), said ring (6) being provided with an external rabbet or recess (9) around the periphery close to its free end defining an annular void (10) between the free end (16) of the ring (6) and, respectively, the cap (5) or the collar (4), towards which the ring (6) may be elastically deformed when it is connected, respectively, to the collar (4) of the tube body or to the cap (5), to make an airtight closure of the tube (20).

15 Claims, 2 Drawing Sheets

FIG. 3
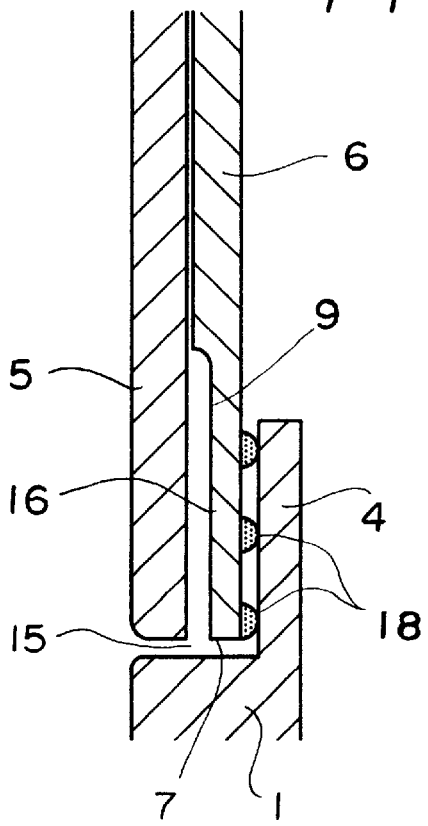
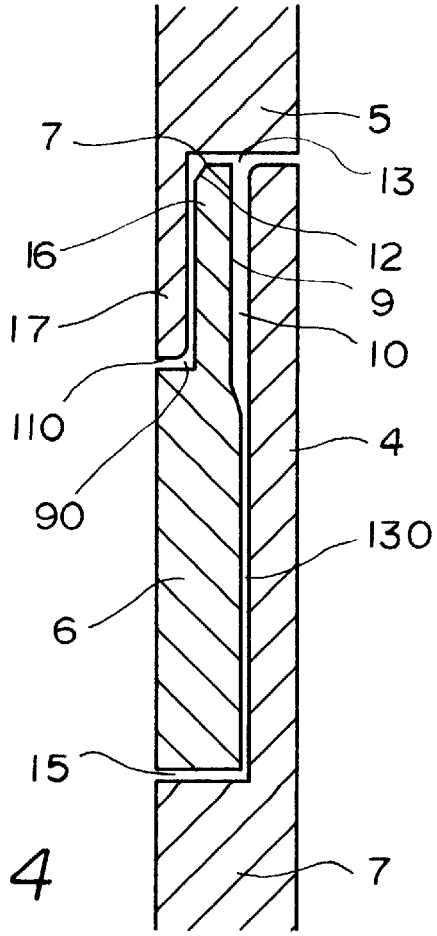
FIG. 4

LIPSTICK TUBES

TECHNICAL DOMAIN

This invention relates to lipstick tubes, designed and structured so as to form an absolutely tight closure of the cap on the tube body in order to prevent the loss of volatile components contributing to formulation of the lipstick, and also contamination of lipstick by particles in suspension in the environment that could entrain smells that could adversely affect the functions of the said lipstick.

STATE OF PRIOR ART

As everyone knows, lipstick tubes usually consist of a basic body supporting the lipstick itself, which can be pushed outwards by means of a helical drive mechanism, this assembly being used with a cap that can be coupled to the open end of the body by pressing on it, this cap providing thorough protection for the lipstick support and the lipstick itself, while providing an aesthetic closure to the entire tube.

In order to ensure that the cap remains in position on the body, the body is usually fitted with small external projections in the area over which the cap opening fits, which cause a slight elastic deformation of the cap with the resulting "clamping" effect on the body which stabilizes the connection between the two elements.

With this attachment system, recesses are necessary between the above mentioned projections which, although they are small, create a passage between the inside and the outside of the tube resulting in the problems mentioned above, namely the loss of volatile components contributing to the formulation of the lipstick and contamination of the said lipstick by its environment.

One obvious solution to this problem would be to make the cap and the body fit perfectly, but apart from the fact that it would be difficult to make in practice, this solution would require an excessive force to be exerted during extraction and replacement operations of the said cap, such that the tube would not be a convenient to use product.

GENERAL DESCRIPTION OF THE INVENTION

The lipstick tube (20) according to the present invention has a cap (5) to be coupled by pressure on a collar (4) emerging axially from the tube body (1), and is characterised in that it comprises a ring of material (6), firmly fixed to said cap (5) or to said collar (4) of said tube body (1), both being made of rigid material, said ring (6) having a flexible free end (16) forming the means of fitting, respectively, of said cap (5) to said collar (4), or of said collar (4) to said cap (5), given that said ring (6) is provided with an external rabbet or recess (9) around the periphery close to its free end defining an annular void (10) between the free end (16) of said ring (6) and, respectively, said cap (5) or said collar (4), towards which the said ring (6) may be elastically deformed when it is connected, respectively, to said collar (4) of the tube body or to said cap (5), to make an airtight closure of said tube (20).

The tubes according to the invention solve the problem mentioned above, by enabling a completely air tight coupling between the cap and the body, without creating any manufacturing problems or subsequent handling problems, and enabling very easy coupling and uncoupling of the said cap.

The air tightness of the tubes does not significantly decreases after a great number of cycles of coupling/uncoupling of the said cap by the user of said tubes.

DESCRIPTION OF THE DRAWINGS

The attached drawings form an integral part of the given description and are provided for illustrative and non-restrictive purposes to complement the written description and to facilitate understanding of the characteristics of the invention.

In FIG. 3, which is similar to FIG. 2, the ring (6) has circular ridges (18).

FIG. 4, which is similar to FIG. 2, shows an embodiment of the invention, in which the ring (6) is fixed to the body (1) of the tube (20), the ring (6) being possibly located inside or outside of the collar (4) of the body (1).

DETAILED DESCRIPTION OF THE INVENTION

Figure 1:
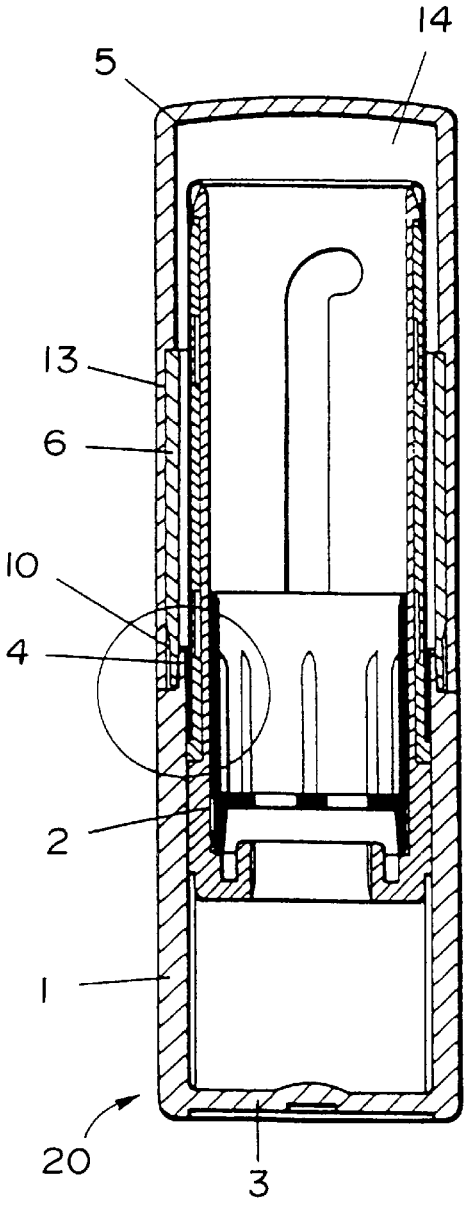
FIG. 1 is a projected side view showing a cross-section through the diameter of a lipstick tube (20), the cap (5) of which is made according to the improvements described in this invention.
Figure 2:
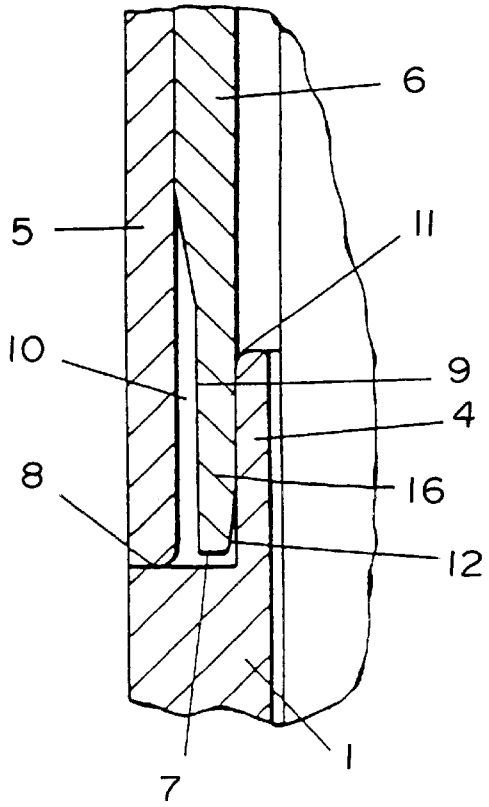
FIG. 2 shows an enlarged detail of the previous figure in the area in which the cap (5) is connected to the body (1). In the embodiment of FIGS. 1 or 2, the ring (6) is fixed to the cap (5).

According to a first embodiment of the invention shown at FIGS. 1 and 2, the ring (6) can be fixed to the cap (5), typically inside the cap (5), the flexible free end (16) of the ring (6) forming the means of fitting of the cap (5) to the rigid collar (4) of the tube body (1), given that the ring (6) is provided with an external rabbet or recess (9) around the periphery close to its free end defining an annular void (10) between the free end (16) of the ring (6) and the cap (5) itself, towards which the said free end (16) may be elastically deformed when said cap (5) is connected to the collar (4) of the tube body, to make an airtight closure.

Typically, the fitting between the free end (16) of the ring (6) and the collar (4) can extend over a distance in the range of 3 to 20 mm.

The rabbet (9) is a recess providing a sufficient margin of deformation so that the ring (6), the diameter of which may be a perfect fit or its dimensions may be slightly smaller than the collar (4) of the tube body (1), deforms and comes into contact with the tube body (1) after its diameter is increased very slightly, but enough to ensure that the coupling between the two parts is perfectly air tight.

The ring (6) could be fixed to the outside of the cover (5), the coupling of both being air tight. This embodiment, which has not been pictured, could correspond to the drawing of FIG. 4, in which the references (1) and (5) on the one side, and the references (4) and (17) on the other side, would be inverted, the tube body (1) playing the role of the cap (5) and reciprocally.

The free end (16) can be provided with an inside diameter slightly smaller than the diameter of the body collar (4) such that its coupling to the body collar (4) slightly deforms the said free end (16) of said ring (6) radially, given that the edge (11) of the collar (4) is rounded and that the free end (16) of the ring has a recessed open end (12) to make it easier to fit the two parts together.

Consequently, the end (7) of the flexible ring open end (16) will be provided with an internal chamfer (12), which makes it slightly tapered, and the corresponding edge (11) on the collar (4) of the tube body will be rounded for the same purpose, as shown on FIG. 2, making it easier to fit the two parts (16, 4) together.

Said ring (6) can fit in an adjusted manner into a stepped rabbet or recess (13) around the periphery of the inside surface of the cap (5), affecting the cap (5) over a variable distance, ranging typically from 15 mm to 40 mm. But the ring (6) may genuinely configure a ring of any length, as shown in FIG. 1, such that it affects more or less the side of the cap itself (5), fitting onto it and being attached by any appropriate means onto the rabbet or recess (13) around the perimeter of the cap (5). The ring (6) may also consist of a dish, the shape and dimensions of which are appropriate for the cap itself (5), and entirely covering the cap, including its top or closed end. The ring (6) remains perfectly stable inside the cap itself within a stepped rabbet or recess (13) in the cap (5), which may extend for a variable distance from the closed end of the cap, the said ring also possibly being closed at one of its ends, thus fitting to the side and equally well to the end of the cap itself without affecting the main feature of the invention, in the same way that it does not affect the method of making the attachment between the two elements, the cap itself and the ring, attachment which can be made easily by adjustment and by pressure, using an adhesive, heat sealing or any other means.

According to a second embodiment of the invention shown at FIG. 4, the ring (6) can be fixed to the collar (4), inside or outside of the collar (4), the flexible free end (16) of the ring (6) forming the means of fitting of the collar (4) to the rigid cap (5), given that the ring (6) is provided with an external rabbet or recess (9) around the periphery close to its free end defining an annular void (10) between the free end (16) of said ring (6) and said collar (4), towards which the free end (16) may be elastically deformed when the collar (4) of the body tube is connected to the cap (5), to make an airtight closure.

As in the first embodiment, on the one hand, the flexible free end (16) can be provided with an inside diameter slightly smaller than the diameter of the body collar (4) such that its coupling to the body collar (4) slightly deforms the said free end (16) of said ring (6) radially, given that the edge (110) of the cap (5) is rounded and that the flexible free end (16) of the ring has a recessed open end (7) to make it easier to fit the two parts together.

On the other hand, the ring (6) can fit in an adjusted manner into a stepped rabbet or recess (15) around the periphery of the inside or outside surface of the collar (4), affecting the collar (4) over a variable distance of the tube body (1).

When the stepped rabbet (15) is the outside surface of the collar (4), the ring (6) should be airtight fixed to the collar (4), by any known means.

Typically, the collar (4) can expand over 10 to 40 mm of the height of the body (1) of the tube.

Preferably, as shown at FIG. 4, the cap (5) has a thinned end (17) fitting with a rabbet or recess (90) of said ring (6), so as to obtain a continuous surface, said surface being internal or external, according to the location of said stepped rabbet (15), respectively inside or outside of the collar (4).

According to the aspect of the tube (20) desired by the tube maker, the ring (6) can be placed inside the collar (4), which makes it not really visible, or outside the collar (4), which makes a part of it visible even when the tube body (1) is connected the cap (5) making the tube (20) airtight, the colour of the ring being possibly different from the colour of the body (1) or the cap (5).

Whatever the embodiment of the invention may be, the thickness of the flexible free end (16) can be in the range 0.3 mm to 0.8 mm.

The flexible ring (6) can be made of a polymer chosen among PE, PP or polyacetal, the preferred polymer being a polyacetal.

The rigid cap (5) or tube body (1) can be made of a polymer chosen among ABS (acrylonitrile-butadiene-styrene) or SAN (styrene-acrylonitrile).

But, the materials, shape, size and layout of the elements may be modified, provided that the essence of the invention is not changed.

According to another embodiment, the contact between the free flexible end (16) and either the collar in the said first embodiment, or the thinned end (17) of the cap (5) in the said second embodiment of the invention, is made air tight with circular ridges (18). Circular ridges (18) allowing for an airtight closure of said tube (20), may be located on either said free flexible end (16), as pictured at FIG. 3, or its cooperating part, i.e. the collar (4) (see FIG. 3), or the thinned end (17) of the cap (see FIG. 4) could have said circular ridges (18).

EMBODIMENTS OF THE INVENTION

Lipstick tubes (20) according the FIGS. 1 and 2, having a height of 70 mm, have been made. These tubes (20) are composed of a tube body (1) comprising a support (2) for the lipstick (not shown) on the inside, the body (1) consequently being hollow, a closed lower base (3) with a collar (4) at the opening of the base on which a cap (5) with a mouth (8) is fitted continuously with the body (1) to protect the lipstick and associated mechanisms.

The ring (6) was made of polyacetal, whereas said body (1) and said cap (5) were made of ABS.

The flexible free end (16) of said ring (6) had a thickness of 0.5 mm.

Other tubes according to the said second embodiment of the invention pictured at FIG. 4, have been made. They were made of the same materials and had the same internal dimensions as the tubes according to the said first embodiment of the invention disclosed before, in order to use the same mechanisms (2) for all types of tubes.

Both versions, with the ring (6) inside or outside the collar (4) have been made.

Tests made with lipsticks tubes and with standard tubes having the same lipsticks with volatile components have shown that the lipsticks packaged in tubes according to the invention did not dry or dried far less than the ones packaged in standard tubes of the art, because, in all cases, the chamber (14) defined between the body (1) and the cap (5) in which the lipstick is placed remains hermetically sealed when the said cap (5) is fitted onto the body (1), in accordance with the purpose of the invention and the resulting advantages for the lipstick.

Obviously, the invention is not limited to the example embodiments described above and illustrated in the figures. These examples may be used to determine other methods and other embodiments without going outside the scope of the invention.

What is claimed is:

1. Lipstick tube (20) comprising a tube body (1) and having a cap (5) to be coupled by pressure on a collar (4) emerging axially from the tube body (1), characterized in that said tube (20) comprises a ring of material (6) having a first portion firmly fixed to the sidewall of the cap (5), said cap and said tube body both being made of rigid material, and a second portion comprising a flexible free end (16) forming the means of fitting of the cap (5) to the collar (4), said second portion having a length less than the length of said first portion, given that the ring (6) is provided with an external rabbet (9) around the periphery close to its free end defining an annular void (10) between the free end (16) of the ring (6) and the cap (5) towards which the ring (6) may be elastically deformed when it is connected to the collar (4) of the tube body to make an airtight closure of the tube (20).

2. Tube according to claim 1, wherein the free end (16) is provided with an inside diameter slightly smaller than the diameter of the body collar (4) such that its coupling to the body collar (4) slightly deforms the free end (16) of the ring (6) radially, given that the edge (11) of the collar (4) is rounded and that the free end (16) of the ring has a recessed open end (12) to make it easier to fit the two parts together.

3. Tube according to claim 1, wherein the ring (6) fits in an adjusted manner into a stepped rabbet (13) around the periphery of the inside surface of the cap (5), affecting the cap (5) over a variable distance, the ring (6) possibly going as far as the top of the cap (5) or even covering the top of the cap in the form of a dish.

4. Tube according to claim 1, wherein the thickness of the flexible free end (16) is in the range 0.3 mm to 0.8 mm.

5. Tube according to claim 1, wherein the flexible ring (6) is made of a polymer chosen among PE, PP or polyacetal.

6. Tube according to claim 1, wherein the rigid cap (5) or the tube body (1) is made of a polymer chosen among ABS or SAN.

7. Tube according claim 1, wherein the free flexible end (16) has circular ridges (18) allowing for an airtight closure of said tube (20).

8. Lipstick tube (20) comprising a tube body (1) and having a cap (5) to be coupled by pressure on a collar (4) emerging axially from the tube body (1), characterized in that said tube (20) comprises a ring of material (6), firmly fixed to the collar (4) of the tube body (1), outside of the collar (4), both said cap and said collar being made of rigid material, the ring having a flexible free end forming the means of fitting of the collar (4) to the rigid cap (5), given that the ring (6) is provided with an internal rabbet (9) around the periphery close to its free end defining an annular void (10) between the free end (16) of the ring (6) and the collar (4), towards which the free end (16) may be elastically deformed when the collar (4) of the body tube is connected to the cap (5), to make an airtight closure.

9. Tube according to claim 8, wherein the free end (16) is provided with an inside diameter slightly smaller than the diameter of the body collar (4) such that its coupling to the body collar (4) slightly deforms the the free end (16) of the ring (6) radially, given that the edge (110) of the cap (5) is rounded and that the free end (16) of the ring has a recessed open end (12) to make it easier to fit the two parts together.

10. Tube according to claim 8, wherein the ring (6) fits in an adjusted manner into a stepped rabbet (15) around the periphery of the inside or outside surface of the collar (4), affecting the collar (4) over a variable distance of the tube body (1).

11. Tube according to claim 10, wherein the cap (5) has a thinned end (17) fitting with a rabbet (90) of the ring (6), so as to obtain a continuous surface, said surface being internal or external, according to the location of the stepped rabbet (15), respectively inside or outside of said collar (4).

12. Tube according to claim 11 wherein the thickness of the flexible free end (16) is in the range of 0.3 to 0.8 mm.

13. Tube according to claim 11 wherein the flexible ring (6) is made of a polymer selected from the group consisting of PE, PP and polyacetal.

14. Tube according to claim 11 wherein the rigid cap 5 or the tube body (1) is made of ABS or SAN.

15. Tube according to claim 11 wherein the free flexible end (16) has circular ridges (18) allowing for an airtight closure of the tube.

* * * * *